US006834635B2

(12) United States Patent
Yomo et al.

(10) Patent No.: US 6,834,635 B2
(45) Date of Patent: Dec. 28, 2004

(54) OUTBOARD MOTOR

(75) Inventors: Shigeki Yomo, Iwata (JP); Hidehiko Yoshioka, Hamamatsu (JP); Shuichi Hagino, Hamamatsu (JP)

(73) Assignee: Suzuki Kabushiki Kaisha, Hamamatsu (JP)

( * ) Notice: Subject to any disclaimer, the term of this patent is extended or adjusted under 35 U.S.C. 154(b) by 105 days.

(21) Appl. No.: 10/260,423

(22) Filed: Oct. 1, 2002

(65) Prior Publication Data

US 2003/0062017 A1 Apr. 3, 2003

(30) Foreign Application Priority Data

Oct. 1, 2001 (JP) ..... 2001-305342
Oct. 2, 2001 (JP) ..... 2001-306565

(51) Int. Cl.[7] ..... F01M 1/00
(52) U.S. Cl. ..... 123/196 AB
(58) Field of Search ..... 123/196 AB, 196 A, 123/196 R; 184/104.1; 440/88 L, 88 C

(56) References Cited

U.S. PATENT DOCUMENTS 5,687,686 A * 11/1997 Takahashi ..... 123/195 P
5,778,848 A * 7/1998 Takahashi et al. ..... 123/196 W
5,980,340 A * 11/1999 Okamoto ..... 440/88 L

* cited by examiner

*Primary Examiner*—Tony M. Argenbright
*Assistant Examiner*—Katrina B. Harris
(74) *Attorney, Agent, or Firm*—Oblon, Spivak, McClelland,Maier & Neustadt, P.C.

(57) ABSTRACT

An outboard motor includes an engine, an engine holder disposed below the engine, a drive shaft housing which is disposed below the engine holder, an intake device including an intake manifold disposed to a side surface of the engine, a lubricant supply device for supplying lubricant oil to the engine, an oil filter disposed below the intake manifold, and an oil cooler arranged below the intake manifold and between the engine and the oil filter. The oil cooler includes a casing and a cooler body disposed inside the casing, and the casing is formed with a cooling water flowing-in union and a cooling water flowing-out union disposed in correspondence with the cooling water flowing-in union.

20 Claims, 7 Drawing Sheets

OUTBOARD MOTOR

BACKGROUND OF THE INVENTION

1. Field of the Invention

The present invention relates an outboard motor especially having an improved structure of an oil cooler.

2. Description of the Related Art

An outboard motor includes an engine, particularly of an internal combustion engine, in which many slidable elements and rotatable elements are arranged. In view of this matter, a lubricating device is used in combination with the so as to supply lubricant oil to respective elements of the engine so as to reduce frictional resistance in the respective elements under a function of the lubricant oil to thereby achieve an adequate performance of the engine of the outboard motor.

There also exists an engine of the outboard motor provided with an oil cooler for cooling lubricant oil, taking into consideration the fact that increase in temperature of the lubricant oil deteriorates its lubricity.

In a conventional four-stroke-cycle engine mounted with an outboard motor, no engine is provided with a water-cooled (water-cooling type) oil cooler which is provided separately from the engine.

However, since the engine of the outboard motor is surrounded with an engine cover, i.e. cowl, it is made difficult to place such an oil cooler and its accessories in a space between the engine (engine body) and the engine cover.

Moreover, in a case where sea water is utilized as cooling water in the water-cooled oil cooler, if the cooling water (i.e. the seawater) is left as it is stored in the oil cooler, the oil cooler may be clogged with salt, thus being troublesome.

SUMMARY OF THE INVENTION

An object of the present invention, which was made to solve the above-mentioned inconveniences, is to provide an outboard motor having an improved structure of an oil cooler and its mounting structure so as to make it possible to place an oil cooler in a permissible small space and improve serviceability thereof.

This and other objects can be achieved according to the present invention by providing an outboard motor comprising:

an engine having a crankcase in which a crankshaft extends perpendicularly in a state of an outboard motor mounted to a hull;

an engine cover in which the engine is arranged;

an engine holder disposed below the engine;

a drive shaft housing which is disposed below the engine holder and in which a drive shaft connected to the crankshaft extends vertically;

an intake device including an intake manifold disposed to a side surface of the engine;

a lubricant supply device for supplying lubricant oil to the engine;

an oil filter disposed below the intake manifold and adapted to filtrate lubricant oil; and an oil cooler arranged below the intake manifold and between the engine and the oil filter.

In preferred embodiments of the above aspect of the present invention, the oil cooler has a cooling water inlet formed to a lower portion of the oil cooler and a cooling water outlet formed to an upper portion of the oil cooler.

An up-streaming passage may be further disposed on an upstream side of the engine, through which the cooling water for the oil cooler is introduced. The up-streaming passage is formed to the engine holder.

A down-streaming passage may be further disposed on a downstream side of the engine, through which the cooling water after passing the oil cooler passes.

The cooling water for the oil cooler is introduced from an upstream side of an engine cooling system and the cooling water after cooling the oil cooler is guided to a downstream side of the engine cooling system.

The oil cooler is provided with a water drain port, which is disposed to a portion corresponding to a full tilt-up angle of the outboard motor.

The oil cooler comprises a casing and a cooler body disposed inside the casing, and the casing is formed with a cooling water flowing-in union and a cooling water flowing-out union disposed in correspondence with the cooling water flowing-in union. The cooler body may be provided with a cooling member which is composed of a plurality of fins formed on an outer surface of the cooling member so as to be in parallel to each other from an outer surface of the cooling member in a direction perpendicular to an axial direction of the cooling member. The cooler body has a cooling member provided with an oil gallery to which the lubricant oil is guided, and a water gallery to which cooling water is guided is formed between the cooling member and the casing, the oil gallery and the water gallery being water-tightly sealed by sealing means. The sealing means includes a first sealing member disposed to joining surfaces between the cooling member and the engine and a second sealing member disposed to joining surfaces between the cooling member and an end wall of the casing on the side of the oil filter, the cooler body is fastened to the engine by means of stand bolt, which is screwed into the engine, so as to come the cooler body into a liquid-tight contact to the engine through the first sealing member, and the casing is urged against the cooling member by screwing the oil filter to the stand bolt so as to hold the end wall of the casing between the cooling member and the oil filter through the second sealing means. Preferably, both the first and second sealing members are O-rings.

The cooling water flowing-in union is provided on a lower portion of a side wall of the casing and the cooling water flowing-out union is provided on an upper portion of the side wall of the casing so as to be opposite to each other.

According to the outboard motor of the above aspects of the present invention, it is possible to provide a simple and compact structure of the outboard motor, dispose the oil cooler in a limited space around the engine, and reduce the number of parts for the outboard motor and simplify the assembling operation of the parts.

In addition, it is possible to provide an effective cooling property of the lubricant oil with the simplified structure and the minimum number of the parts as reduced.

Furthermore, it is also possible to carry out an easy disassembling and maintenance operation of the oil cooler and prevent the oil cooler from being clogged with salt.

The natures and further characteristic features of the present invention will be made more clear from the following descriptions made with reference to the accompanying drawings.

DESCRIPTION OF THE PREFERRED EMBODIMENTS

A preferred embodiment of the present invention will be described in detail hereunder below with reference to the accompanying drawings.

Figure 1:
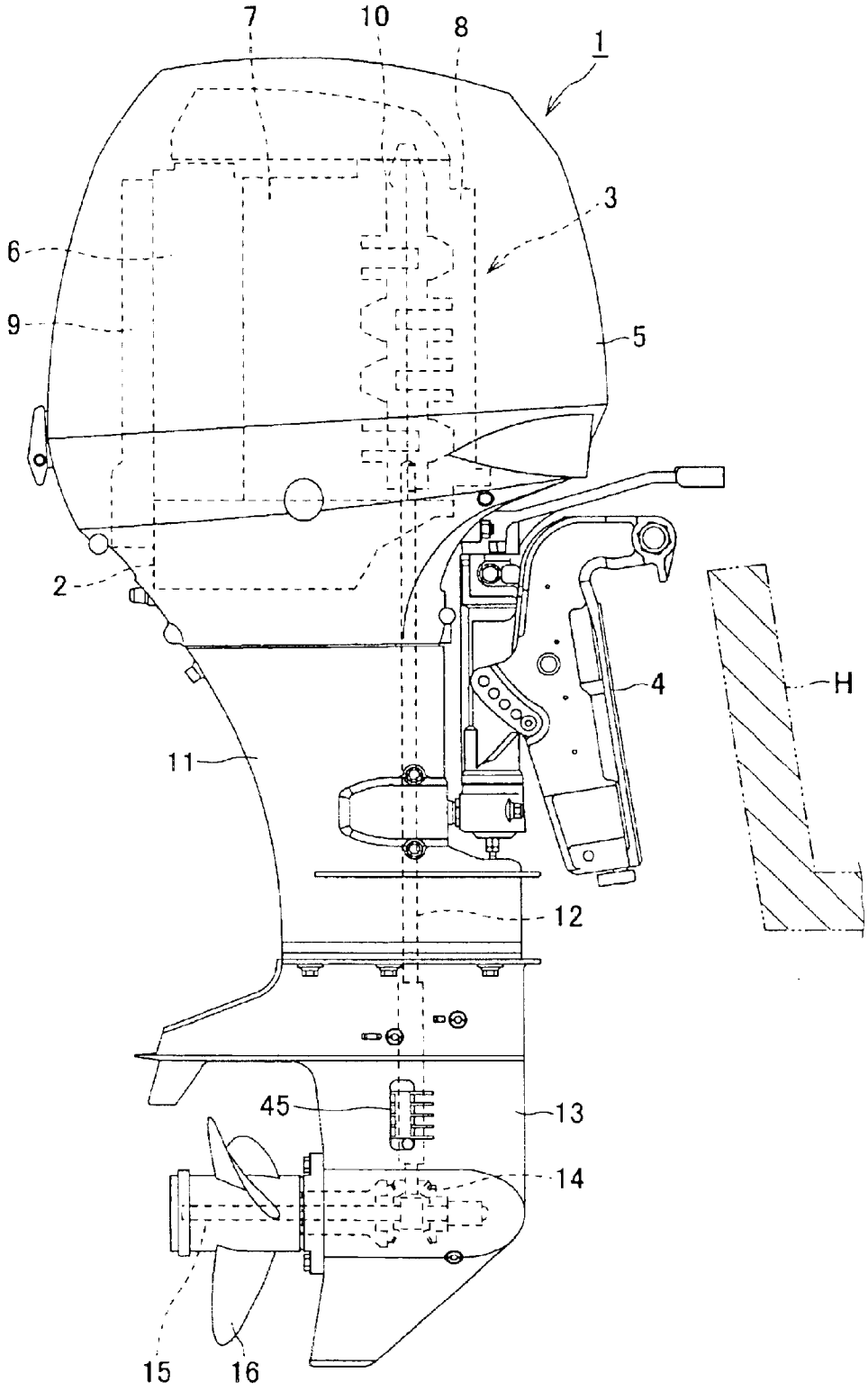
FIG. 1 is a right-hand side view illustrating an outboard motor, in a state mounted to a hull, to which the present invention is applicable.

First, with reference to FIG. 1 illustrating an outboard motor to which the present invention is applied, the outboard motor 1 includes an engine holder 2 and an engine (internal combustion engine) 3 disposed above the engine holder 2. A clamp bracket 4 is connected to the engine holder 2, and the outboard motor 1 is mounted to a transom of a hull H through the clamp bracket 4. The engine 3 is surrounded with an engine cover 5, so-called a cowl.

Figure 2:
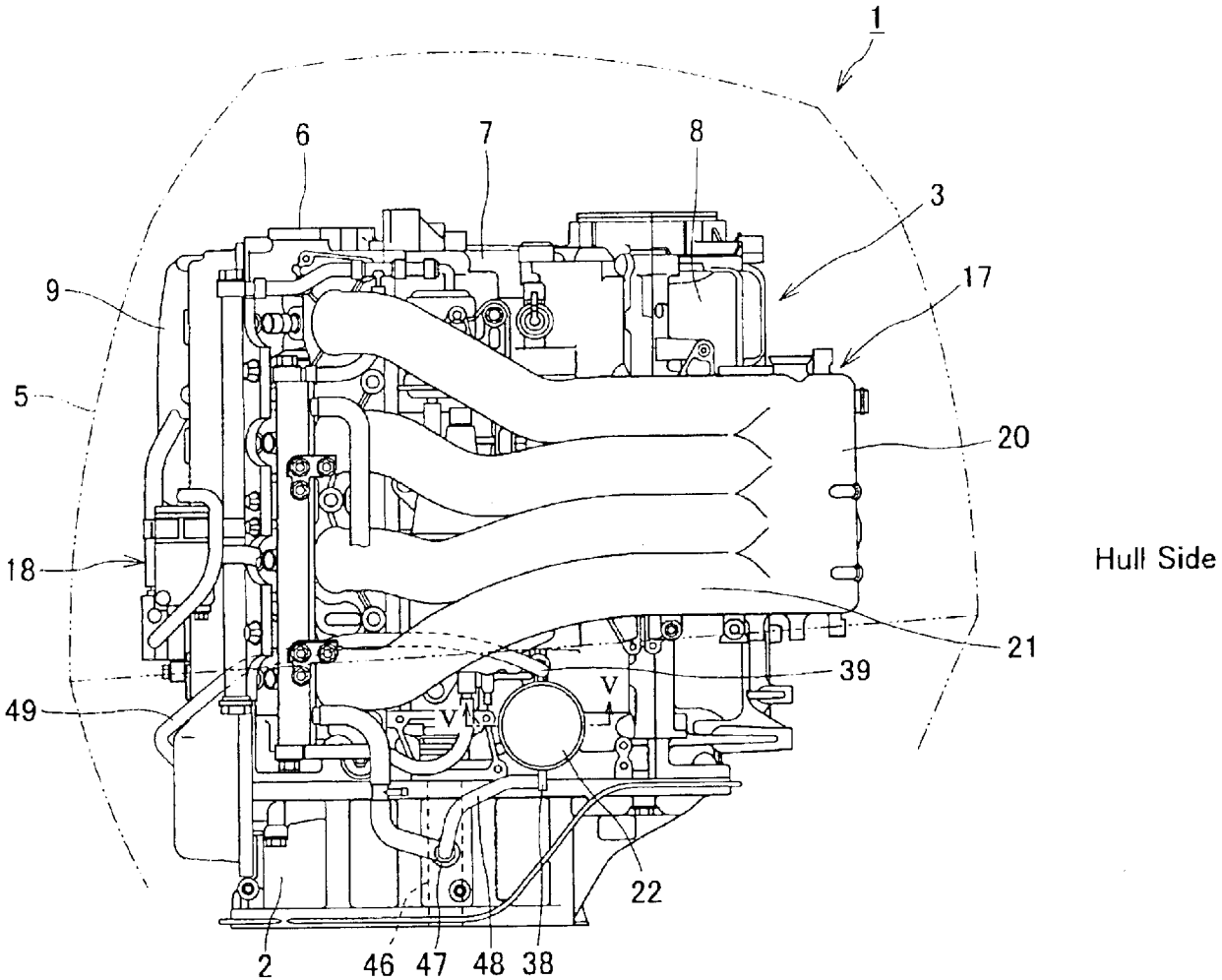
FIG. 2 is a right-hand side view, in an enlarged scale, illustrating an engine mounted in the outboard motor of FIG. 1.
Figure 3:
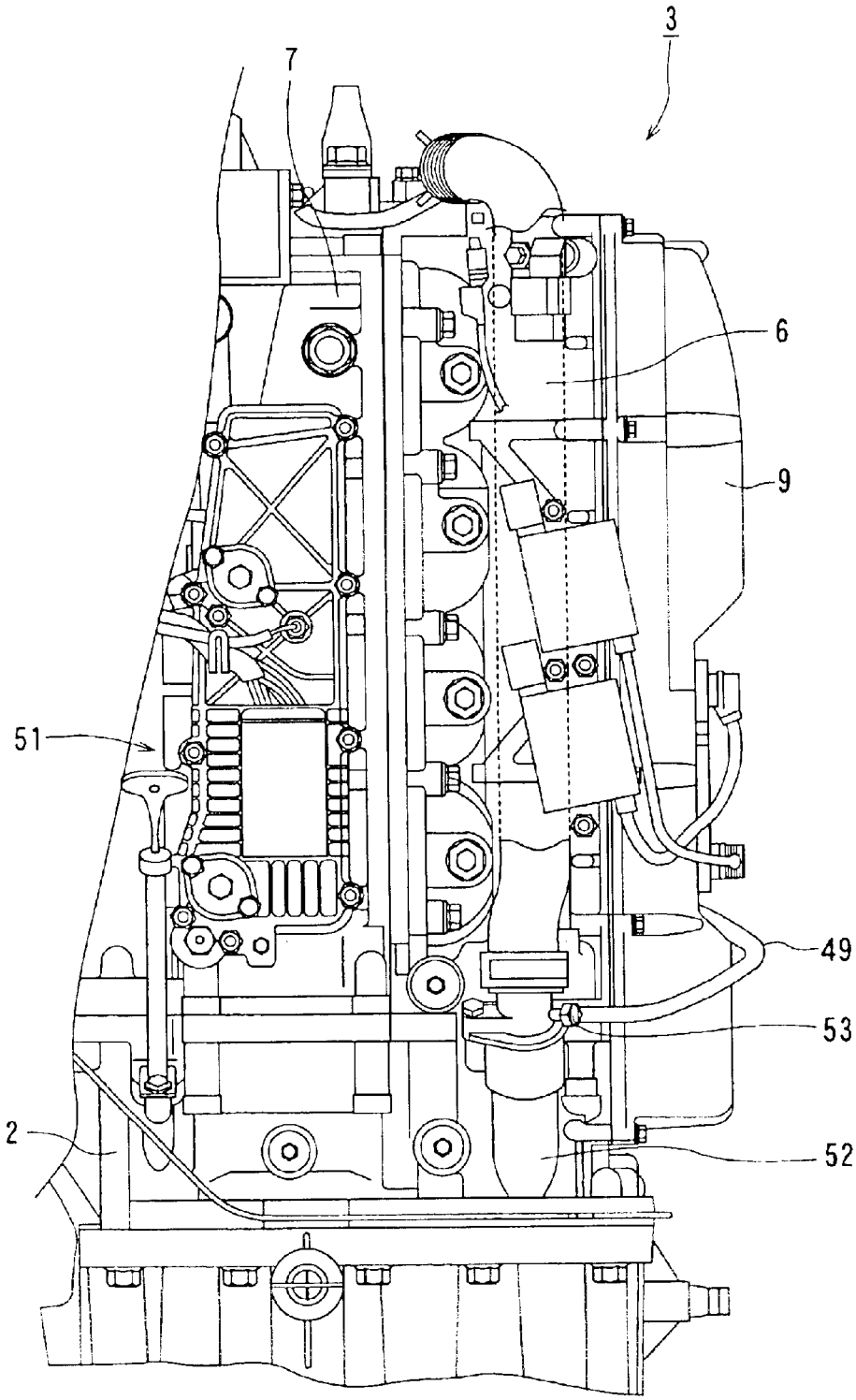
FIG. 3 is a left-handside view, in an enlarged scale, of the rear side of the engine of FIG. 2.

FIGS. 2 and 3 show detail of the engine 3, and with reference to FIGS. 1 to 3, the engine 3 mounted to the outboard motor 1 is, for example, a water-cooled four-stroke-cycle straight type four-cylinder engine having a main body composed of engine-parts such as a cylinder head 6, a cylinder block 7 and a crankcase 8 in combination. The above-mentioned main body of the engine 3 is placed above the engine holder 2 in a state of the outboard motor mounted to the hull H such as shown in FIG. 1.

In this mounted state, the cylinder block 7 is disposed on the rear side (i.e., the left-hand side in FIG. 2) of the crankcase 8, which is disposed at the forward end of the engine 3 and placed on the right-hand side in FIG. 2. The cylinder head 6 is disposed on the rear side of the cylinder block 7. The rear side of the cylinder head 6 is covered by a cylinder head cover 9. A crankshaft 10 is disposed substantially perpendicularly in the engine crankcase so as to pass through contacting (joining) surfaces of the crankcase 8 and the cylinder block 7 as shown in FIG. 1.

Description will be given to an arrangement below the engine 3. A drive shaft housing 11 is disposed below the engine 3. The lower end of the crankshaft 10 is connected to the upper end of a drive shaft 12 through a spline connection. The drive shaft 12 passes through the drive shaft housing 11 so as to extend downward. The drive shaft 12 drives a propeller 16 through a bevel gear 14 and a propeller shaft 15, which are received in a gear case 13 disposed below the drive shaft housing 11.

Figure 4:
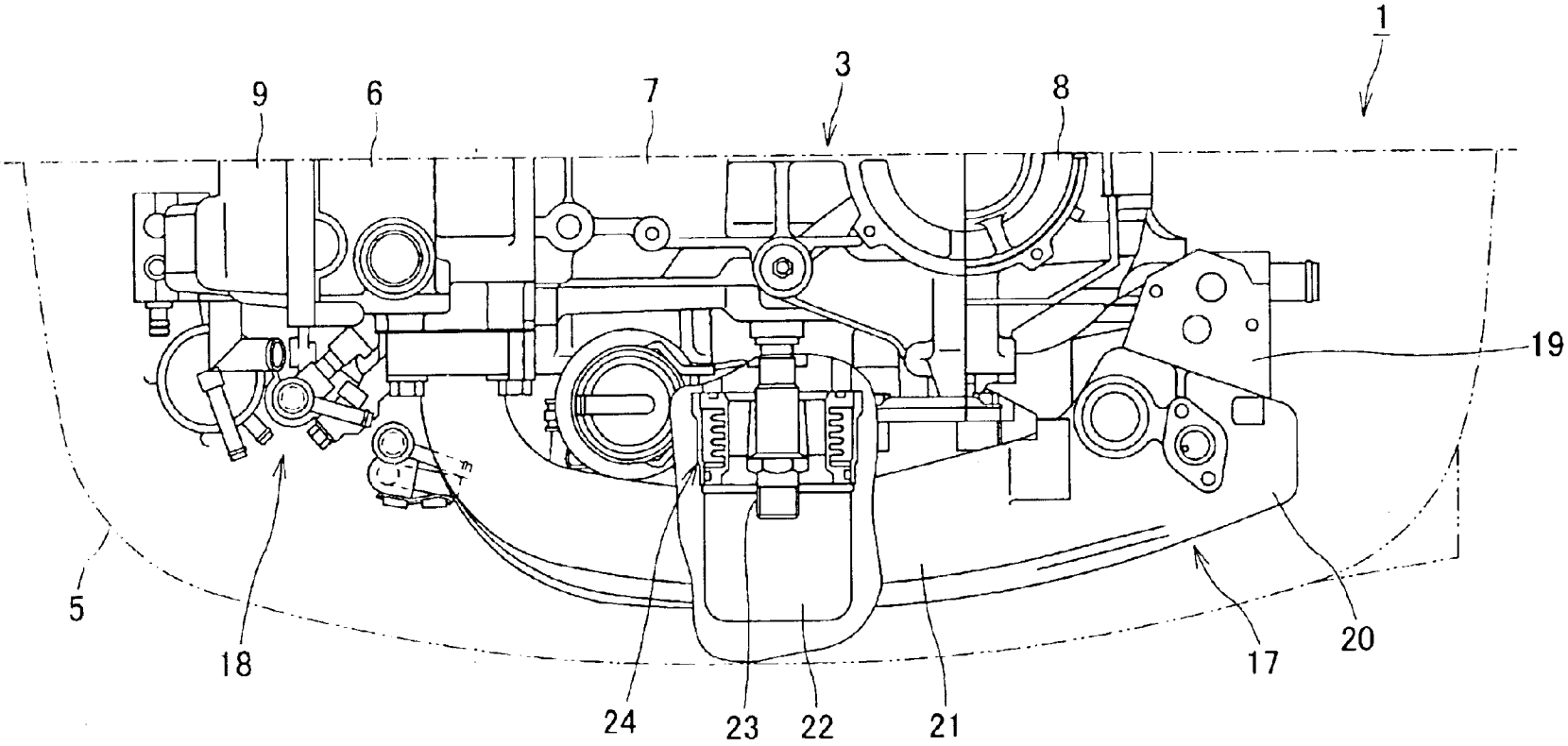
FIG. 4 is a plan view illustrating the right-half side of the engine.

FIG. 4 is a plan view illustrating the right-half side of the engine 3. Electrical equipment 51, an intake unit 17, a fuel supply unit 18 and the other structural elements are disposed on the periphery of the engine 3 as engine peripheral equipments. The intake unit 17, which is mainly composed of a throttle body 19, a surge tank 20 and an intake manifold 21 that extends from the surge tank 20 to the respective cylinders, is disposed in a gathered state on one side of the engine 3, i.e. on the right-hand side of the engine 3 in the embodiment of the present invention.

The intake manifold 21, which is disposed on the side of the cylinder block 7 so as to extend vertically, causes the respective intake ports (not shown) of the cylinders formed in the cylinder head 6 to communicate with the inside of the surge tank 20. The electrical equipment 51 is disposed in a gathered state on the opposite side to the intake unit 17, i.e. on the left-hand side of the engine 3 in the embodiment of the present invention.

An oil filter 22 for filtering lubricant oil is disposed on the lower side of the right-hand side surface of the cylinder block 7, which is placed below the intake manifold 21 to form the main body of the engine 3. The oil filter 22 is secured to the side surface of the cylinder block 7 by means of a hollow stand bolt 23 extending in the width direction of the engine 3 so that the oil cooler 24 is clamped and held between the cylinder block 7 and the oil filter 22, as shown in FIG. 4.

Figure 5:
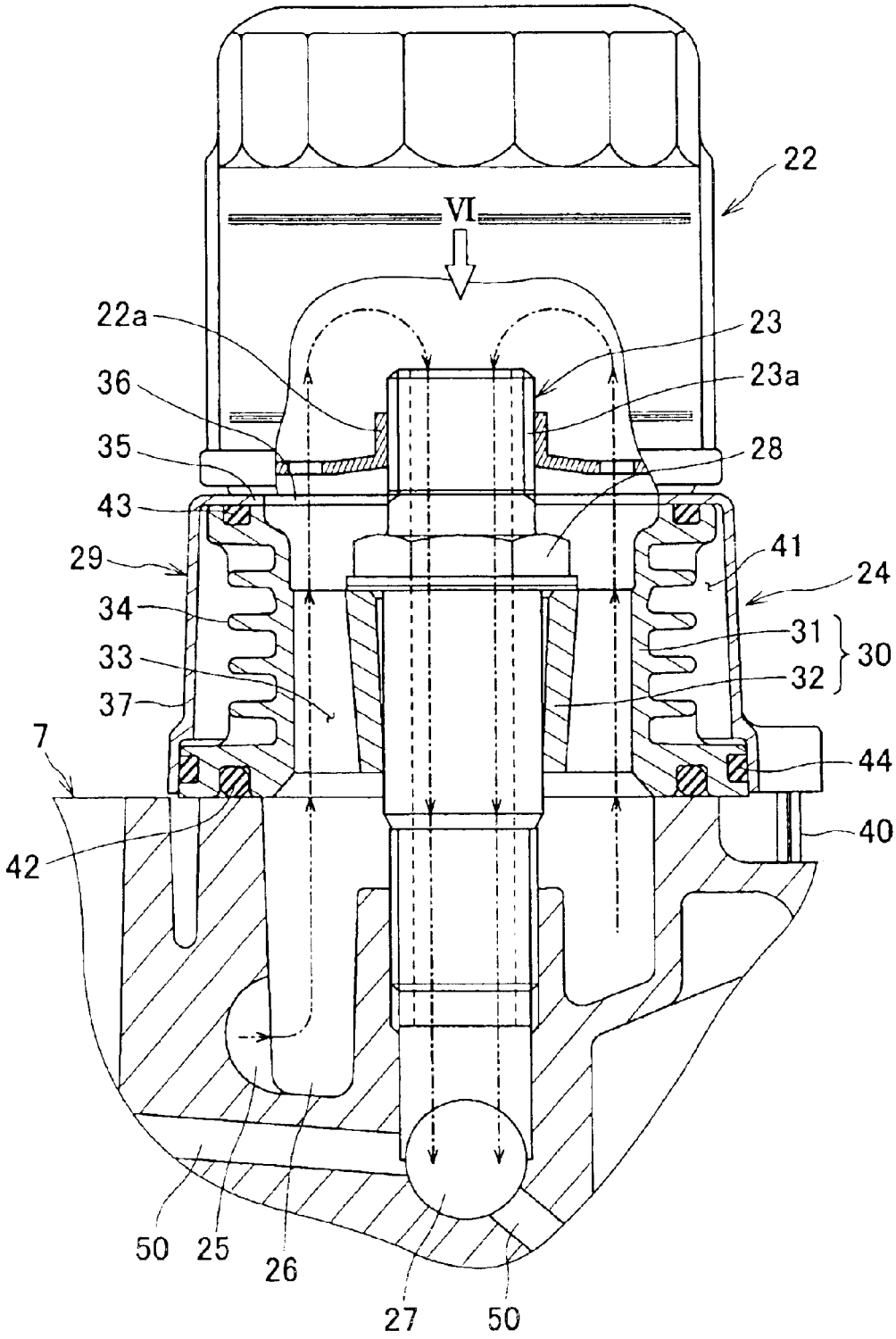
FIG. 5 is a cross-sectional view taken along the line V—V in FIG. 2.
Figure 6:
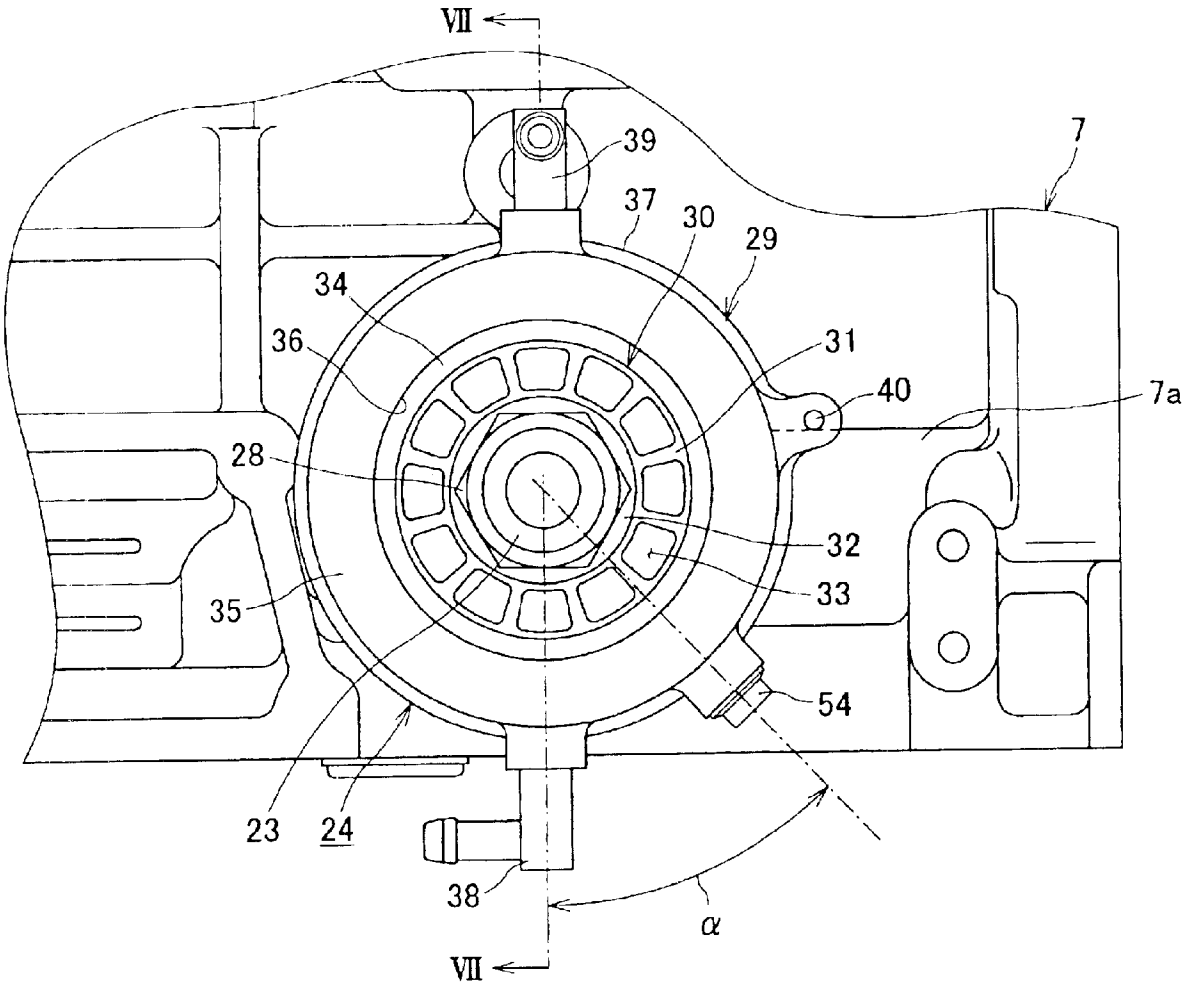
FIG. 6 is a view illustrating an oil cooler, which is viewed in a direction of an arrow VI in FIG. 5.
Figure 7:
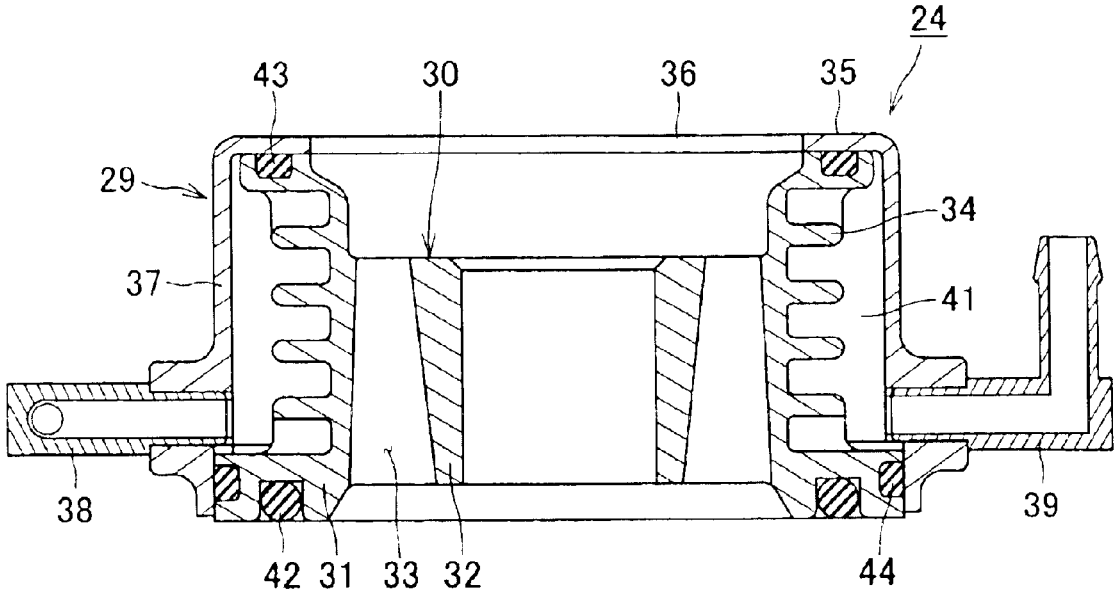
FIG. 7 is a cross-sectional view taken along the line VII—VII in FIG. 6.

FIG. 5 is a cross-sectional view cut along the line V—V in FIG. 2, which shows cross section of the oil filter 22 and the oil cooler 24. FIG. 6 is a view illustrating the oil cooler, which is viewed in a direction of an arrow VI as shown in FIG. 5. FIG. 7 is a cross-sectional view cut along the line VII—VII in FIG. 6.

As shown in FIGS. 5 to 7, the cylinder block 7 is provided with an oil passage 25 extending so as to communicate with an oil pan, not shown, disposed below the engine, and with another oil passage formed in the engine holder 2. In addition, the cylinder block 7 has an oil reservoir 26 formed on the right-hand surface thereof. The lubricant oil is introduced through the above-mentioned oil passage 25 into the oil reservoir 26.

The oil cooler 24 is mounted on the side surface of the cylinder block 7 so as to close the oil reservoir 26. The oil cooler 24 is fixed to the cylinder block 7 by fastening a nut 28, which is integrally provided for the hollow stand bolt 23 and which is screwed into the cylinder block 7.

The outlet end of the hollow stand bolt 23, which is screwed into the cylinder block 7, communicates with a main gallery 27 formed in the cylinder block 7. The stand bolt 23 has a male-threaded portion 23*a,* which projects outside from the oil cooler 24. The oil filter 22 has a female-threaded portion 22*a,* which engages with the male-threaded portion 23*a* of the stand bolt 23 and is tighten so that the oil cooler 24 is clamped and held between the cylinder block 7 and the oil filter 22.

The oil cooler 24 is mainly composed of a casing 29 and a cooler body (main body of cooler) 30 received in the casing 29. The cooler body 30 is composed of a cooling member 31 having, for example, a hollow cylindrical shape and a boss 32, which is placed in the center of the cooling member 31 so as to receive the stand bolt 23. An oil gallery 33 is formed between the cooling member 31 and the boss 32. The cooling member 31 is provided, on its outer surface, with a plurality of fins 34 extending in parallel to each other in a direction perpendicular to the axial direction of the cooling member 31.

The casing 29 has a bottomed cylindrical structure comprising a hollow cylindrical side wall 37 and an end wall 35 formed at the one end (upper end as viewed in FIG. 5) of the side wall integrally therewith. The end wall 35 has an opening 36, which has a diameter substantially identical to that of the oil gallery 33. The side wall 37 of the casing 29 has upper and lower connection holes, which are opposite to each other. A cooling water flowing-in union 38 is connected to the above-mentioned lower connection hole by, for example, forcedly inserting the former into the latter, and on the other hand, a cooling water flowing-out union 39 is connected to the above-mentioned upper connection hole by, for example, forcedly inserting the former into the latter.

The side wall 37 of the casing 29 is formed with a pin insertion hole into which a positioning pin 40 is forcedly inserted (see FIG. 5) so as to position the casing 29 through an engagement with a rib 7*a* disposed to the cylinder block 7. A water gallery 41 into which cooling water is to be introduced is formed between the cooling member 31 of the cooler body 30 and the casing 29 thereof. The water gallery 41 communicates with the cooling water flowing-in union 38 and the cooling water flowing-out union 39.

Furthermore, a water drain port 54 is provided for a side portion of the side wall 37 of the casing 29 for draining the cooling water in the water gallery 41. This water drain port 54 is disposed to a position corresponding to a full tilt-up angle $\alpha$ of the outboard motor 1 (FIG. 6) so as to completely drain the cooling water in the water gallery 41 even at the tilt-up time of the outboard motor 1. In the above, the term "full tilt-up angle" means an tilting angle of the outboard motor in a state that the top portion thereof is fully tilted towards inside the hull when mounted.

An O-ring 42 serving as a first sealing member is placed between the abutting (joining) surfaces of the cooling member 31 of the cooler body 30 and the cylinder block 7. The boss 32 of the cooling member 31 is fastened to the cylinder block 7 by means of the stand bolt 23 so as to bring the cooling member 31 into a liquid-tight contact to the cylinder block 7 through the O-ring 42.

An O-ring 43 serving as a second sealing member is placed between the abutting (joining) surfaces of the cooling member 31 and the end wall 35 of the casing 29, which is placed in the vicinity of the oil filter 22. The female-threaded portion 22*a* of the oil filter 22 is tightened to the male-threaded portion 23*a* of the stand bolt 23 to urge the casing 29 against the cooling member 31, thus bringing the end wall 35 of the casing 29 into a liquid-tight contact to the one end of the cooling member 31 through the O-ring 43.

In addition, a further O-ring 44 is placed between the outer peripheral surface of the end of the cooling member 31, which is placed in the vicinity of the cylinder block 7, and on the one hand, the inner peripheral surface of the end of the casing 29, which is opposite to the end wall 35 thereof. As a result, the other end of the casing 29, which is opposite to the end wall 35 thereof, is brought into a liquid-tight contact to the other end of the cooling member 31 through this O-ring 44 under friction.

As shown in FIG. 1, a water inlet port 45 is provided for the side surface of the gear case 13. A pumping-up action by a water pump, not shown, which is driven by the drive shaft 12, causes cooling water such as sea water to be introduced through a water intake passage, not shown, into an up-streaming water passage 46 (see FIG. 2), which is formed in the engine holder 2.

As shown in FIG. 2, the engine holder 2 is provided, for example, on the right-hand surface thereof, with a cooling water outlet port 47, which communicates with the above-mentioned up-streaming water passage 46. The cooling water outlet port 47 and the cooling water flowing-in union 38 are communicated through a water feed pipe 48 to thereby introduce a portion of the cooling water before being introduced into the engine 3 to the oil cooler 24.

The engine holder 2 is provided on the left-hand surface thereof with a down-streaming water passage 52. A cooling water discharging union 53, which is provided for this down-streaming water passage 52, is connected to the cooling water flowing-out union 39 by means of discharging pipe 49. Therefore, the cooling water after cooling the lubricating oil is combined with the cooling water cooling the respective elements of the engine 3, which is then drained.

Operation and function of the present invention of the embodiment mentioned above will be described hereunder.

With reference to FIG. 5, lubricant oil received in the oil pan is pumped up and introduced, by means of oil pump, through the oil passage 25 formed in the cylinder block 7 into the oil reservoir 26, which is formed on the right-hand side surface of the cylinder block 7. The lubricant oil introduced into the oil reservoir 26 is then introduced to the oil filter 22 through the oil gallery 33 formed between the cooling member 31 and the boss 32, which form the oil cooler 24, so that foreign matters in the lubricant oil is filtered through a filter element, not shown.

The lubricant oil, which has been subjected to the filtering process by means of the oil filter 22, flows through the inner hollow portion of the stand bolt 23 so as to be supplied to the main gallery 27 formed in the cylinder block 7 and then to be supplied through an oil branch passage 50 to the respective members to be lubricated in the engine 3.

The cooling water pumped up from the water inlet ports 45, which are formed on the opposite sides of the gear case 13, is introduced through the up-streaming water passage 46, which is formed in the engine holder 2, from the cooling water flowing-in union 38, which is provided on the lower side of the side wall 37 of the casing 29 for forming the oil cooler 24, into the water gallery 41 formed between the cooling member 31 of the cooler body 30 and the casing 29 thereof.

The cooling water introduced into the water gallery 41 comes into contact to the fins 34, which are formed on the outer surface of the cooling member 31 so as to extend in parallel to each other in the direction perpendicular to the axial direction of the cooling member 31, to cool the lubricant oil received in the oil gallery 33, which is formed between the cooling member 31 and the boss 32 for forming the cooler body 30. The cooling water is then discharged out of the oil cooler 24 from the cooling water flowing-out union 39, which is provided on the upper side of the side wall 37 of the casing 29 so as to be opposite to the cooling water flowing-in union 38. Then, the cooling water is discharged through the discharging pipe 49 into the down-streaming water passage 52, which is provided in the engine holder 2.

The oil cooler 24 is disposed below the intake manifold 21 arranged on the side surface of the cylinder block 7 constituting the engine body. Accordingly, the ambient temperature less affects on the performance of the oil cooler 24, and the dead space inside the engine cover can be effectively utilized.

The oil cooler 24 is disposed so as to be clamped and held between the cylinder block 7 and the oil filter 22 on the side surface of the cylinder block 7 for forming the body of the engine 3 in a manner as described above. Such an arrangement makes it possible to negate the necessity for additional parts exclusively used for mounting the oil cooler 24, thus providing a simple and compact structure of the outboard motor. In addition, it is possible not only to dispose the oil cooler 24 in a limited space around the engine 3, which is covered with the engine cover 5, but also to reduce the number of parts or elements for the outboard motor, thus simplifying the assembling working and operation of the parts or elements.

Furthermore, in the present invention, there is adopted a structure in which the oil cooler 24 is composed of the casing 29 and the cooler body 30 received in the casing 29, the cooling member 31 for forming the cooler body 30 is provided with the fins 34, and the casing 29 is provided with the cooling water flowing-in union 38 and the cooling water flowing-out union 39. Accordingly, such a structure makes it possible to achieve an effective cooling performance of the lubricant oil with the simplified structure and the minimum number of the parts as reduced.

In the case where seawater is utilized as the cooling water in the water-cooled oil cooler 24, and the cooling water (i.e., the sea water) is left as is stored in the oil cooler, the oil cooler 24 may be clogged with salt. Furthermore, the water gallery 41 is formed between the cooling member 31 of the cooler body 30 and the casing 29 thereof, and the cooling member 31 and the casing 29 are brought into a liquid-tight contact to each other through the O-rings 43, 44 serving as the second sealing member. This structure makes it possible to carry out an easy disassembling and maintenance operation of the oil cooler 24 and to prevent the oil cooler 24 from being clogged with salt. Moreover, since the cooling water flowing-in union 38 formed as an inlet of the cooling water at the lower portion of the side wall 37 of the casing 29 and the cooling water flowing-out union 39 as an outlet of the cooling water at the upper portion of the side wall are disposed so as to oppose to each other, the cooling water can flow without staying in the water gallery 41 even if the operation of the engine 3 stops and the water flow hence stops, thus also preventing the salt clogging.

Furthermore, according to the structure of the present invention, the O-ring 42 serving as the first sealing member is placed between the contacting, i.e. joining, surfaces of the cooling member 31 and the cylinder block 7, the boss 32 of the cooling member 31 is fastened to the cylinder block 7 by means of stand bolt 23 so as to bring the cooling member 31 into a liquid-tight contact to the cylinder block 7 through the O-ring 42, the O-ring 43 serving as the second sealing member is placed between the contacting surfaces of the cooling member 31 and the end wall 35 of the casing 29, which is placed in the vicinity of the oil filter 22, the other O-ring 44 also serving as the second sealing member is placed between the outer peripheral surface of the end of the cooling member 31, which is placed in the vicinity of the cylinder block 7. Furthermore, the inner peripheral surface of the end of the casing 29, which is opposite to the end wall 35 thereof, and the casing 29 is urged against the cooling member 31 by screwing the oil filter 22 on the end portion of the stand bolt 23 so as to bring the casing 29 into a liquid-tight contact to the cooling member 31 through the O-rings 43, 44. According to such a structure, the number of parts or elements can be reduced and the length of the oil cooler 24 in the axial direction thereof is prevented from increasing.

Still furthermore, according to the present invention, the cooling member 31 is provided on its outer surface with a plurality of fins 34, extending in parallel to each other in the direction perpendicular to the axial direction of the cooling member 31. This makes it possible to increase the contact area between the outer surface of the cooling member 31 and the cooling water, thus improving the cooling efficiency of the lubricant oil.

In addition, the casing 29 is provided, on the lower side of its side wall 37, with the cooling water flowing-in union 38 and, on the upper side of the side wall 37, with the cooling water flowing-out union 39 so as to be opposite to the cooling water flowing-in union 38. Therefore, it is made possible to prevent the cooling water from staying in the water gallery 41, even when the operation of the engine 3 is halted to stop the cooling water from being supplied. Occurrence of clogging of the oil cooler 24 with salt can therefore be prevented.

Still furthermore, since the cooling water for the oil cooler 24 is taken from the upstream side of the engine cooling system, i.e. through the up-streaming passage 46 in the engine holder 2 disposed upstream side of the engine 3, fresh and cooled cooling water can be supplied to the oil cooler 24, thus improving the cooling effect to the lubricant oil.

In addition, the cooling water after passing the oil cooler 24 is guided to the downstream side of the engine cooling system, i.e. the down-streaming passage 52 disposed downstream side of the engine 3. Accordingly, a heat transferred through the cooling of the lubricant oil can be prevented from being transferred to parts or elements of the engine 3.

Still furthermore, the water drain port 54 is formed to the casing 29 of the oil cooler 24 to a position corresponding to the full tilt-up angle of the outboard motor 1, so that the cooling water in the oil cooler 24 can be fully drained even if the outboard motor 1 is fully tilted up, thus effectively preventing the clogging with salt.

Further, it is to be noted that the present invention is not limited to the described embodiment and many other changes and modifications may be made without departing from the scopes of the appended claims.

For example, in the described embodiment of the present invention, the O-ring 43 disposed on the oil filter 22 side provides the sealing function on the plane perpendicular to the axial direction of the cooling member 31, and on the one hand, the other O-ring 44 disposed on the cylinder block 7 side provides the sealing function on the circumferential surface of the cooling member 31. It may, however, be adopted a structure in which the O-ring 43 is disposed to provide the sealing function on the circumferential surface of the cooling member 31, and on the one hand, the other O-ring 44 is disposed to provide the sealing function on the plane perpendicular to the axial direction of the cooling member 31. Such structure will provide substantially the same effects as those of the described embodiment.

In the described embodiment, the sealing members 42, 43, 44 provide the liquid-tight sealing condition between the casing 29 and the cooling member 31. It may, however, be adopted a structure in which at least one of the opposite end portions of the cooling member 31 in the axial direction is forcedly inserted into the casing 29 so as to provide a liquid-tight sealing condition without using any sealing member.

What is claimed is:

1. An outboard motor comprising:

an engine having a crankcase in which a crankshaft extends perpendicularly in a state of an outboard motor mounted to a hull;

an engine cover disposed to cover the engine arranged inside thereof;

an engine holder disposed below the engine;

a drive shaft housing which is disposed below the engine holder and in which a drive shaft connected to the crankshaft extends vertically;

an intake device including an intake manifold disposed to a side surface of the engine;

a lubricant supply device for supplying lubricant oil to the engine;

an oil filter disposed below the intake manifold, adapted to filtrate lubricant oil, and mounted to the side surface of the engine; and an oil cooler arranged below said intake manifold and between said engine and said oil filter.

2. An outboard motor according to claim 1, wherein said oil cooler has a cooling water inlet formed to a lower portion of the oil cooler and a cooling water outlet formed to an upper portion of the oil cooler.

3. An outboard motor according to claim 1 further comprising an up-streaming passage, disposed on an upstream side of the engine, through which the cooling water for the oil cooler is introduced.

4. An outboard motor according to claim 3, wherein said up-streaming passage is formed to the engine holder.

5. An outboard motor according to claim 3, further comprising a down-streaming passage, disposed on a downstream side of the engine, through which the cooling water after passing the oil cooler passes.

6. An outboard motor according to claim 1, wherein the cooling water for the oil cooler is introduced from an upstream side of an engine cooling system and the cooling water after cooling the oil cooler is guided to a downstream side of the engine cooling system.

7. An outboard motor according to claim 1, wherein said oil cooler is provided with a water drain port, which is disposed to a portion corresponding to a full tilt-up angle of the outboard motor.

8. An outboard motor according to claim 1, wherein said oil cooler comprises a casing and a cooler body disposed inside the casing, and said casing is formed with a cooling water flowing-in union and a cooling water flowing-out union disposed in correspondence with the cooling water flowing-in union.

9. An outboard motor according to claim 8, wherein said cooler body is provided with a cooling member which is composed of a plurality of fins formed on an outer surface of the cooling member so as to be in parallel to each other from an outer surface of the cooling member in a direction perpendicular to an axial direction of the cooling member.

10. An outboard motor according to claim 8, wherein said cooler body has a cooling member provided with an oil gallery to which the lubricant oil is guided, and a water gallery to which cooling water is guided is formed between the cooling member and the casing, said oil gallery and said water gallery being water-tightly sealed by sealing means.

11. An outboard motor according to claim 10, wherein said sealing means includes a first sealing member disposed to joining surfaces between the cooling member and the engine and a second sealing member disposed to joining surfaces between the cooling member and an end wall of the casing of the oil cooler on the side of the oil filter, said cooler body is fastened to the engine by means of stand bolt, which is screwed into the engine, so as to come the cooler body into a liquid-tight contact to the engine through the first sealing member, and said casing is urged against the cooling member by screwing the oil filter to the stand bolt so as to hold the end wall of the casing between the cooling member and the oil filter through the second sealing means.

12. An outboard motor according to claim 11, wherein said first and second sealing members are O-rings.

13. An outboard motor according to claim 8, wherein said cooling water flowing-in union is provided on a lower portion of a side wall of the casing and said cooling water flowing-out union is provided on an upper portion of the side wall of the casing so as to be opposite to each other.

14. An outboard motor comprising:

an engine having a crankcase in which a crankshaft extends perpendicularly in a state of an outboard motor mounted to a hull, an engine cover disposed to cover the engine arranged inside thereof, an engine holder disposed below the engine;

a drive shaft housing which is disposed below the engine holder and in which a drive shaft connected to the crankshaft extends vertically;

an intake device including an intake manifold disposed to a side surface of the engine;

a lubricant supply device for supplying lubricant oil to the engine;

an oil filter disposed below the intake manifold and adapted to filtrate lubricant oil; and an oil cooler arranged below said intake manifold and between said engine and said oil filter, wherein the cooling water for the oil cooler is introduced from an upstream side of an engine cooling system and the cooling water after cooling the oil cooler is guided to a downstream side of the engine cooling system.

15. An outboard motor comprising:

an engine having a crankcase in which a crankshaft extends perpendicularly in a state of an outboard motor mounted to a hull;

an engine cover disposed to cover the engine arranged inside thereof;

an engine holder disposed below the engine;

a drive shaft housing which is disposed below the engine holder and in which a drive shaft connected to the crankshaft extends vertically;

an intake device including an intake manifold disposed to a side surface of the engine;

a lubricant supply device for supplying lubricant oil to the engine;

an oil filter disposed below the intake manifold and adapted to filtrate lubricant oil; and an oil cooler arranged below said intake manifold and between said engine and said oil filter, wherein said oil cooler comprises a casing and a cooler body disposed inside the casing, and said casing is formed with a cooling water flowing-in union and a cooling water flowing-out union disposed in correspondence with the cooling water flowing-in union.

16. The outboard motor according to claim 15, wherein said cooler body is provided with a cooling member which is composed of a plurality of fins formed on an outer surface of the cooling member so as to be in parallel to each other from an outer surface of the cooling member in a direction perpendicular to an axial direction of the cooling member.

17. The outboard motor according to claim 15, wherein said cooler body has a cooling member provided with an oil gallery to which the lubricant oil is guided, and a water gallery to which cooling water is guided is formed between the cooling member and the casing, said oil gallery and said water gallery being water-tightly sealed by sealing means.

18. The outboard motor according to claim 17, wherein said sealing means includes a first sealing member disposed to joining surfaces between the cooling member and the engine and a second sealing member disposed to joining surfaces between the cooling member and an end wall of the casing of the oil cooler on the side of the oil filter, said cooler body is fastened to the engine by means of stand bolt, which is screwed into the engine, so as to come the cooler body into a liquid-tight contact to the engine through the first sealing member, and said casing is urged against the cooling member by screwing the oil filter to the stand bolt so as to hold the end wall of the casing between the cooling member and the oil filter through the second sealing means.

19. The outboard motor according to claim 18, wherein said first and second sealing members are O-rings.

20. The outboard motor according to claim 15, wherein said cooling water flowing-in union is provided on a lower portion of a side wall of the casing and said cooling water flowing-out union is provided on an upper portion of the side wall of the casing so as to be opposite to each other.

* * * * *